United States Patent [19]

Sheriff

[11] Patent Number: 4,516,468

[45] Date of Patent: May 14, 1985

[54] DOUBLE ACTING TELESCOPIC CYLINDER CONSTRUCTION

[75] Inventor: Merle M. Sheriff, Carlsbad, Calif.

[73] Assignee: Hydraulic Technology Corporation, Naples, Fla.

[21] Appl. No.: 456,122

[22] Filed: Jan. 10, 1983

[51] Int. Cl.[3] ..... F01B 7/20

[52] U.S. Cl. ..... 91/169; 91/422; 92/52; 92/110; 92/128; 92/143

[58] Field of Search ..... 91/167 R, 169, 407, 91/422, 438; 92/51, 52, 53, 110, 128, 143

[56] References Cited

U.S. PATENT DOCUMENTS

| | | | |
|---|---|---|---|
| 2,517,153 | 8/1950 | Wood | 91/169 |
| 2,783,744 | 3/1957 | Tennis | 91/169 |
| 2,897,791 | 8/1959 | Routledge | 91/169 |
| 3,212,604 | 10/1965 | Garnett | 92/110 |
| 3,426,649 | 2/1969 | Koppers | 91/422 |
| 3,442,178 | 5/1969 | Daniels | 91/405 |
| 3,631,765 | 1/1972 | Neumeister | 92/53 X |
| 3,656,411 | 4/1972 | Plester et al. | 91/422 |
| 4,303,005 | 12/1981 | Glomski et al. | 92/53 |

FOREIGN PATENT DOCUMENTS

| | | | |
|---|---|---|---|
| 2290613 | 6/1976 | France | 92/53 |
| 128536 | 11/1928 | Switzerland . | |
| 438 | of 1912 | United Kingdom | 91/405 |

*Primary Examiner*—Robert E. Garrett
*Assistant Examiner*—Timothy E. Nauman
*Attorney, Agent, or Firm*—Oliver D. Olson

[57] ABSTRACT

A double acting telescopic hydraulic cylinder comprises a hollow base member arranged to be supported pivotally and including a removably end closure at its inner end. The interior surface of the base member incorporates a set of machined grooves which removably mount a set of rings that act as a stop, a fluid seal, a bearing and a wiper for the largest of a plurality of telescoping cylinder stages each incorporating a similar set of internal machined grooves and rings which cooperate with the adjacent smaller stage. The smallest telescopic cylinder stage receives a hollow telescopic piston stage closed at its inner and outer ends. An internal groove on the inner end of each telescoping cylinder stage removably mounts a lifting ring for engaging the next smaller stage. An external groove on the inner end of each stage removably mounts a guide bearing ring for cooperation at its forward end with the stop ring of the adjacent larger stage.

11 Claims, 6 Drawing Figures

DOUBLE ACTING TELESCOPIC CYLINDER CONSTRUCTION

BACKGROUND OF THE INVENTION

This invention relates to telescopic hydraulic cylinders, and more particularly to a double acting telescopic hydraulic cylinder construction which provides for the use of thin wall tubing and removably attachable bearing, seal, stop, wiper, guide and lifting rings, thereby eliminating welding, threading and excessive machining of cylinder tubing.

Normally, telescopic hydraulic cylinders are constructed in one of two basic ways. One way is to start with thick wall tubing and form lifting rings, stops and bearing and seal grooves thereon by machining away metal from the tubing, on appropriate inside and outside surfaces of the various cylinder components. A second typical method is to use standard wall tubing and afix by welding, threading or other means, composite annular members shaped to provide lifting rings, stops and bearing and seal grooves.

Applicant's copending patent application Ser. No. 294,818, filed Aug. 20, 1981, now abandoned discloses a telescopic hydraulic cylinder construction which utilizes a plurality of uniform thin wall steel tubings having grooves machined on the inner and outer surfaces thereof for the removable mounting of such rings. However, the construction affords only single action operation of the cylinders, whereas there are many industrial applications wherein double acting telescopic hydraulic cylinders are required or are at least advantageous.

SUMMARY OF THE INVENTION

In its basic concept, the double acting telescopic hydraulic cylinder of this invention utilizes a plurality of the thin wall tubings, machined grooves and rings of my earlier co-pending application and adds thereto a piston on the inner end of each stage desired to be made double acting, a closed inner end on the innermost stage and a fluid pressure inlet communicating through said innermost stage with the outer side of the piston for applying retracting pressure for the associated stage.

It is by virtue of the foregoing basic concept that the principal objective of this invention is achieved; namely, the provision of a dual acting telescopic hydraulic cylinder construction which avoids the excessive machining and fabrication costs of prior construction methods of telescopic hydraulic cylinders.

Another object of this invention is to provide a double acting hydraulic cylinder of the class described in which all parts, manufacturing procedures, assembly and testing procedures are identical to those used in the manufacture of a single acting cylinder in accordance with my co-pending application, except for the simple addition of a piston member to each stage desired for double acting movement, the closure of the inner end of the innermost cylinder and the provision of a retract oil port in the latter cylinder.

Another object of this invention is the provision of a telescopic hydraulic cylinder which may be arranged either as single acting, double acting, or combination of both, and which also may include shock dampening mechanism.

A further object of this invention is the provision of a telescopic hydraulic cylinder of the class described which is of simplified construction for economical manufacture, repair and maintenance.

The foregoing and other objects and advantages of this invention will appear from the following detailed description, taken in connection with the accompanying drawings of preferred embodiments.

DESCRIPTION OF THE PREFERRED EMBODIMENTS

Figure 1:
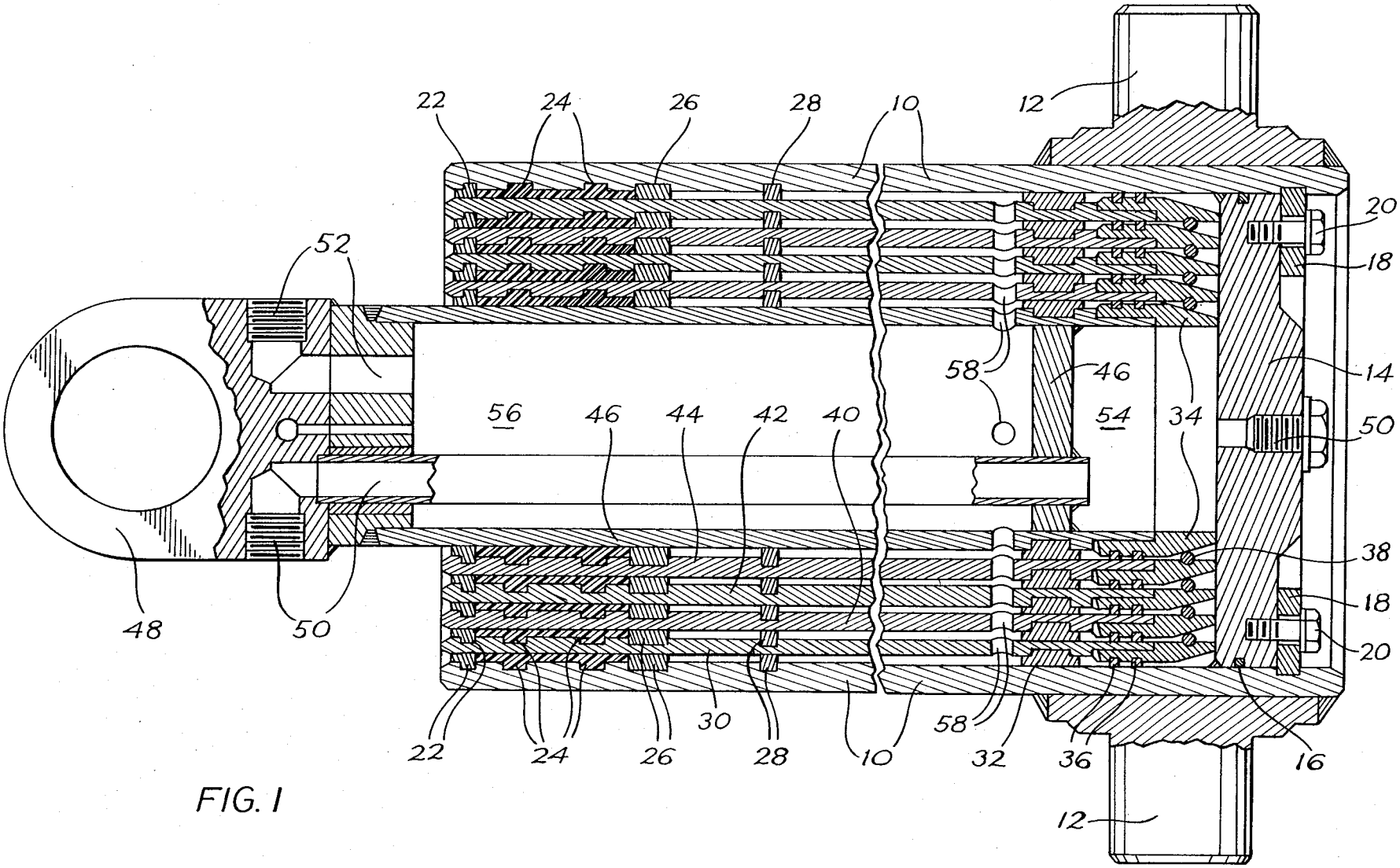
FIG. 1 is a foreshortened, longitudinal section of a multi-stage hydraulic cylinder embodying the features of this invention, the same being shown in retracted position with all stages arranged for double action.

The telescopic hydraulic cylinder of this invention includes a hollow base member 10 which is secured to any desired suitable mount, as by means of the trunnions 12 illustrated. The base member 10 also includes an end closure, or blind head 14 at one end, provided with an annular fluid pressure seal 16. It is held in place removably by a segmented ring 18 seated in an annular groove in the base member and secured to the end closure by bolts 20. The ring may include any number of segments desired.

The opposite, outer end of the base member 10 is machined with a plurality of internal grooves arranged to receive outer end performance rings. In the embodiment illustrated, there are five such grooves configured, respectively, to removably receive a wiper ring 22, bearing rings 24, seal ring 26 and stop ring 28. The wiper ring is arranged outermost to prevent the entrance of foreign material that might be clinging to the outside surface of the adjacent telescoping stage during its retraction into the base member. The bearing rings are positioned adjacent the wiper ring and are of suitable material for providing a running, guiding fit with the outside surface of the adjacent telescoping stage. The seal ring is of a material to prevent hydraulic fluid leakage between the base member and adjacent telescoping stage during operation of the cylinder. The stop ring is provided inwardly of the seal ring to limit the outward extension of the adjacent telescoping stage, as explained more fully hereinafter.

The telescopic hydraulic cylinder also includes at least one and most often a plurality of telescoping cylinder stages, each configured to be successively smaller in diameter so as to be receivable within the next larger stage. Beginning with the largest stage illustrated, i.e.

the cylinder 30 adjacent the base member 10, it is formed of a tubing having an outside diameter substantially equal to the inside diameter of the rings 22, 24, and 26 on the base member. As shown, the cylinder 30 incorporates on its inner surface, adjacent the end opposite the blind head 14 of the base member, five machined grooves for receiving a set of removable rings 22, 24, 26 and 28 similar to those incorporated on the inner surface of the base member 10. In addition, the cylinder 30 includes near its end adjacent the blind head of the base member a groove on its outside surface for receiving a guide bearing ring 32. This ring is arranged for sliding contact with the inside surface of the base member 10.

There is also mounted, either by welding or by threaded connection on the end portion of the cylinder 30 adjacent the blind head 14, a piston member 34 mounting piston rings 36 arranged for sealing engagement with the inside surface of base 10. There is also provided on the inside surface of the piston 34 a groove arranged to receive a lifting ring 38.

Each of the remaining successively smaller telescoping cylinder stages 40, 42, and 44 illustrated in the fully double acting cylinder construction of FIG. 1 includes the same arrangement of grooves, rings and pistons just described.

The innermost tubing 46 constitutes a piston cylinder stage. It is devoid of the inner grooves for the rings 22, 24, 26 and 28, as provided for the outer stages. Rather, it incorporates only an outside groove near its end adjacent the blind head 14 arranged to removably receive a guide bearing ring 32. A piston member 34 on the inner end of the tubing 46 mounts piston rings 36 arranged for sealing engagement with the inside of cylinder stage 44. Like the preceding piston members 34, the piston member on the tubing 46 is arranged for abutment by the lifting ring 38 of the next adjacent outer telescoping cylinder stage. The inner portion of the piston cylinder tubing 46 is closed by a plug 46' as illustrated. Also shown, the tubing 46 mounts a connector 48 at its outer end arranged for coupling to a load to be moved, such as the mechanism of a dump truck.

Means for injecting hydraulic fluid into the interior of the cylinder assembly for the extension mode of the stages and for retraction mode of the double acting stages is provided by extension fluid port 50 and retraction fluid port 52, respectively. In the embodiment illustrated, the oil inlets are through the connector 48. The extension port 50 extends through the length of the piston 46 and plug 46' into cylinder cavity 54 behind the plug, to effect the lifting of each stage. The retraction port 52 extends into the interior of the piston cavity 56, and communicates with openings 58 in the walls of the stage tubes 46, 44, 42, 40 and 30 to effect the retraction mode.

As previously mentioned, these tubings preferably are of a special hydraulic steel tubing drawn over a mandrel to special tolerances, finishes and eccentricities. With the ring components illustrated and described, this tubing requires no finishing operations on the inside diameter. The only machining required after facing and chamfering the ends is to machine the internal grooves on one end of the base and telescoping cylinder stages for the wiper, bearing, seal and stop rings 22, 24, 26 and 28, respectively; one external groove on the opposite end of each of the telescoping cylinder stages 30, 40, 42, and 44 for a guide ring 32; and one internal groove on the base member 10 for the locking ring 18. The only other operation is external grinding done on a centerless grinding machine directly without preliminary machining.

Each of the guide rings 32 is a multi-purpose ring preferably made of high strength cast iron and split in two halves. This ring fits in the groove machined on the outside diameter of the telescoping cylinder stages and piston and provides three main functions. First, it functions as a guide sliding directly on the inside diameter of the adjacent outer tubing. Second, it functions as an abutment which, on contact with the stop ring 28 of the adjacent outer tubing, limits the stroke of the stage and takes the full force of the stage as exerted by the hydraulic pressure. Third, in the embodiment of FIG. 3 described hereinafter, it functions as the contact point of the lifting ring 38 of the adjacent outer tubing which takes the full lifting force in the outer direction at the beginning of the extension stroke.

The guide ring bears against the accurately ground outside surface of the supporting tubing, rather than against the machined bottom of its mounting groove. This assists the ring in providing maximum strength of all components in both directions and good guiding on the mating stage.

Each stop ring 28 is a one piece split ring that act as the other mating stop point for the associated guide ring 32 at the outer end of the extension stroke. It preferably is made of nodular iron and is snapped in place in the appropriate groove during assembly.

The bearing rings 24 preferably are of reinforced plastic. They are split and are designed to snap into place in the machined grooves in the tubings. The inner end of each ring acts as support for the seal ring 26 and the outer end for supporting the wiper ring 22. This arrangement eliminates the need for special devices to hold these components in place.

The lifting rings 38 are spring steel split rings of rather standard design. They are arranged removably in the grooves on the inside surface of the telescoping cylinder piston members 34 for abutting contact either with the chamfered outer surface of the piston member 34 of the next adjacent smaller cylinder (FIG. 1), or with the guide bearing rings 32 in the grooves on the outside surface of the adjacent smaller stage in the embodiment of FIG. 3.

FIG. 1 shows fluid passage bores 58 extending through the tubing walls of the telescoping cylinder stages and piston adjacent the guide rings 32. These bores permit free passage of hydraulic fluid under pressure into the interiors of these components during the retraction mode. Hydraulic fluid is also allowed to pass around the guide rings 32 in the retraction mode, and lifting rings 38 in extension mode.

Assembly of the telescopic hydraulic cylinder for the fully double acting arrangement of FIG. 1 is as follows: First, all piston rings, stop rings, seals, bearings and wipers are installed in place. Next, the largest cylinder stage 30 is slipped into the base member 10 before the blind head 14 is installed. The next succeeding smaller stages are then slipped into their adjacent larger stages, and finally the piston stage 46 into the smallest cylinder stage. As each stage reaches the guide groove for the guide ring 32, the two halves of the guide ring are put into the groove and the stage slid into place, with the piston rings 36 bearing against the inner surface of the adjacent outer cylinder. The lifting ring 38 is installed on each piston member 34 after the next inner stage has been moved into place. Finally, the blind head 14 is installed. Disassembly follows the reverse sequence.

The operation of the double acting telescopic cylinder from the closed position of FIG. 1, is as follows: Hydraulic fluid under pressure is delivered from a source (not shown) to the extension oil inlet port 50 to fill the cylinder cavity 54. Oil port 52 is connected to the exhaust side (sump) of the fluid pressure source. This oil pressure is applied against the inner side of the double acting piston rings 36. The various stages thereupon start to move out of the base member against the opposition of the load applied to the connector 48. The largest stage 30, having the greatest piston ring area, moves outward first. As it moves, each successive lifting ring 38 contacts the confronting chamfered surface of the piston 34 of the next smaller stage until all of the cylinder stages and the piston stage 46 move together to lift the load.

When the abutting edge of the guide ring 32 of the first stage 30 comes in contact with the corresponding stop ring 28 of the base member 10, the first stage comes to a halt. The remaining stages continue to move outward successively, until the piston stage 46 is fully extended or the oil pressure is shut off.

For retraction of the double acting stages of the cylinder, port 52 is connected to the pressure source and port 50 to sump. Oil enters port 52 under pressure and flows into piston cavity 56, thence through openings 58 in the piston wall into the cavity between the outside diameter of the piston tube and the inside diameter of the next tube, and thus past the guide ring 32 and against the outer sides of the piston rings 36. The piston stage then retracts until the piston rings pass the port 58 in the next larger stage, thereby pressurizing that stage and thus causing it to retract. This action continues with each succeeding stage until the cylinder is fully retracted.

During retraction of the cylinder stages, any foreign matter such a dirt or debris clinging to the tubings is prevented from entering the cylinders by the wiping action of the wiper rings 22.

Figure 3:
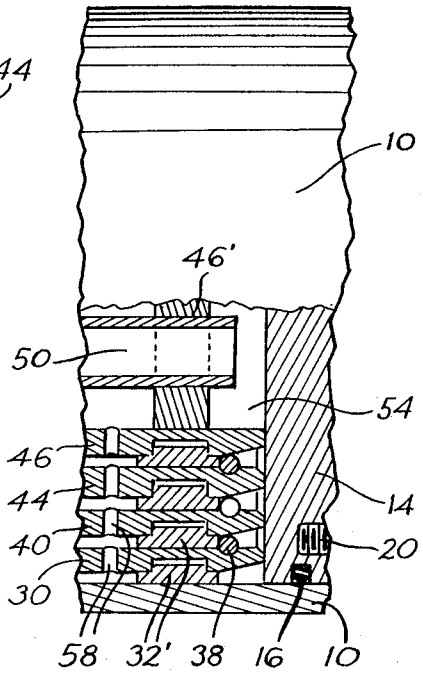
FIGS. 3 is another embodiment of the cylinder of FIG. 1 with the guide rings arranged to replace the piston members and piston rings in FIG. 1.

Referring to the embodiment of FIG. 3, the cylinder is illustrated to utilize the construction of the copending patent application Ser. No. 294,818, now abandoned, previously mentioned, with the exception that each pair of semi-circular guide rings described therein, and also shown in FIG. 1 as rings 32, is replaced by a single split ring 32'. This guide ring 32' is produced with adequate resiliency to be able to be spread apart far enough to allow it to be slid over the stage until it meets its groove machined on the outside surface of the stage, whereupon it snaps tightly into place.

By virtue of this new split construction of the guide rings 32', the guide rings acts as a hydraulic fluid seal against the inner surface of the adjacent larger stage, thereby substituting for the piston assembly 34,36 described previously. Accordingly, by utilizing this construction the previously described assembly of piston 34 and piston rings 36 may be omitted. However, each telescoping stage 30, 40 and 44 will of course include an internal groove adjacent the blind head end for receiving a lifting ring 38 as in the copending application.

Rings 32' also provide a surface against which the lifting rings 38 of the adjacent larger stage abuts during extension of the cylinder. The remainder of the cylinder construction of FIG. 3 is similar to FIG. 1.

Figure 2:
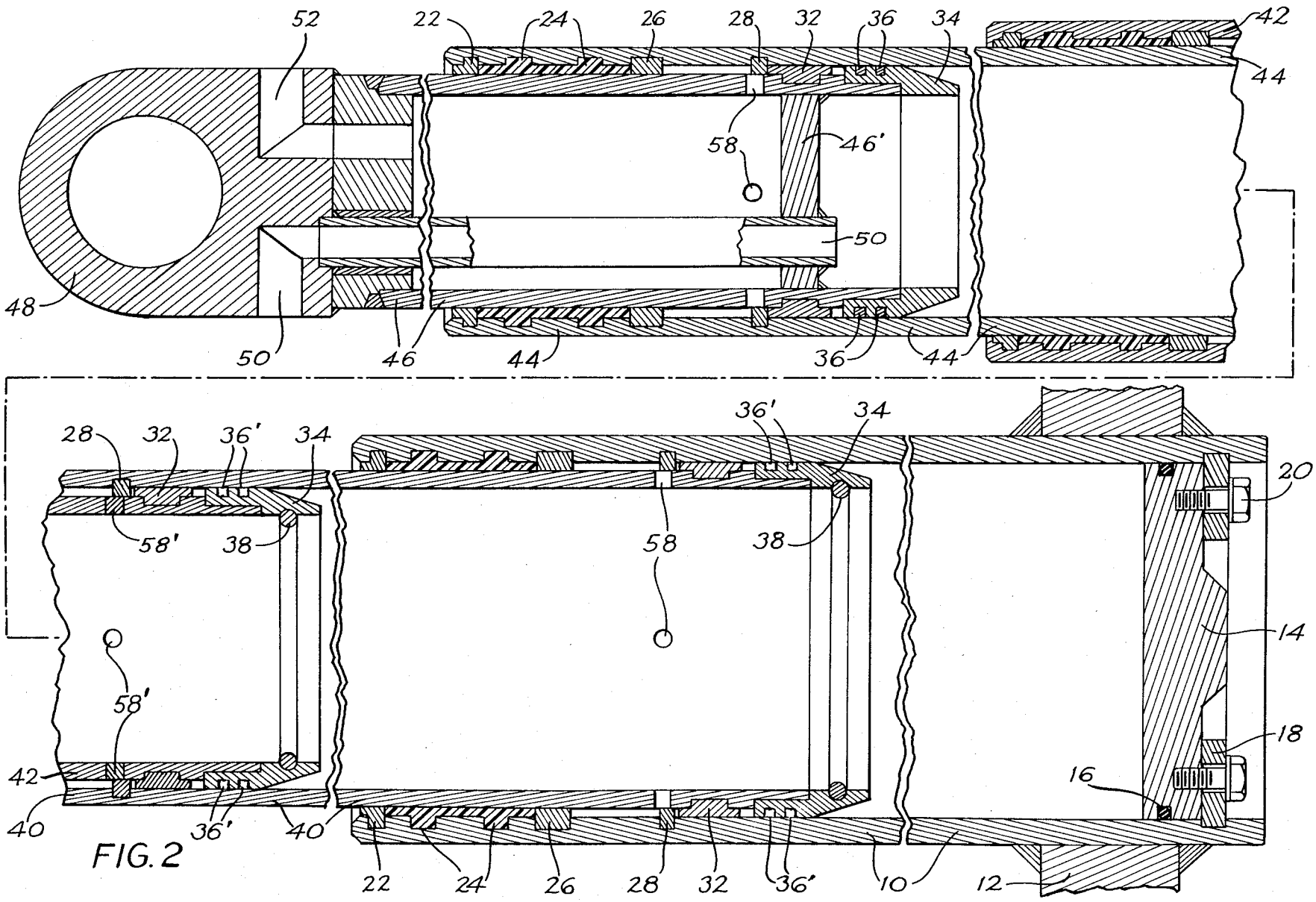
FIG. 2 is a foreshortened, longitudinal section of a multi-stage hydraulic cylinder embodying the features of this invention, the same being shown in extended position with the innermost stage only arranged for double action by omitting the piston rings in the subsequent stages.
Figure 4:
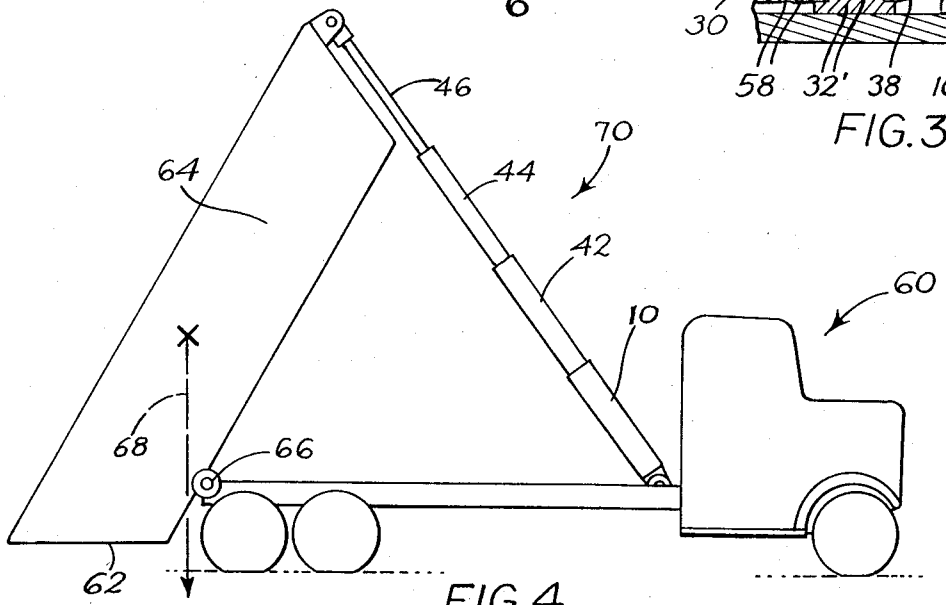
FIG. 4 is a schematic representation of a dump truck showing the dump box fully elevated to a position in which the center of gravity is located rearwardly of the pivot axis of the box.

It will be appreciated that the cylinder assembly thus far described may utilize a construction whereby various selected stages may be provided the foregoing means for the double acting mode while others may be provided only the single acting mode. FIG. 2 illustrates such a cylinder construction shown in fully extended condition, as for the purpose illustrated in FIG. 4.

On some dump trucks 60, especially certain off-the-road type trucks, there is a long overhang 62 of the bed 64 past its pivot shaft 66 on the vehicle. In this configuration, when the truck bed 64 is fully tipped, the center of gravity of the empty bed is moved rearward of its pivot 66, as indicated by the line 68, in FIG. 4. Accordingly, it is required that the bed be pulled forward sufficiently to move the center of gravity 68 forwardly of the pivot 66. The bed assembly 70 will then come down of its own weight by being able to retract the single acting stages of a telescopic hydraulic cylinder. This requires a cylinder assembly 70 that is double acting in only the last or piston stage 46.

As FIG. 2 illustrates, the piston stage 46 includes the piston member 34 and piston rings 36 as discussed previously. However, the successively larger stages 44 and 42 (a three stage cylinder being illustrated), are made single acting by removing the piston rings 36 from the piston members 34, as illustrated by the unfilled grooves 36', or by removing the entire piston members In the embodiment, the openings 58 in the stage adjacent the piston stage are blocked off, as by plugs 58', or are eliminated. This separates the double acting stage from the single acting stages, and thereby effectively separates the retract oil cavity 56 from the extend oil cavity 54. Alternatively, the single acting stages may be provided in the manner of the copending application.

When large rocks are to be dumped from the bed 64, it is possible for one to stick, and then roll down the bed and strike the end of the overhang 62 with enough force to "self-tip" the vehicle, causing the truck and the cylinder to reach full tip position rather violently. To compensate for this it is desirable to modify the last stage to incorporate a shock absorber feature.

Figure 5:
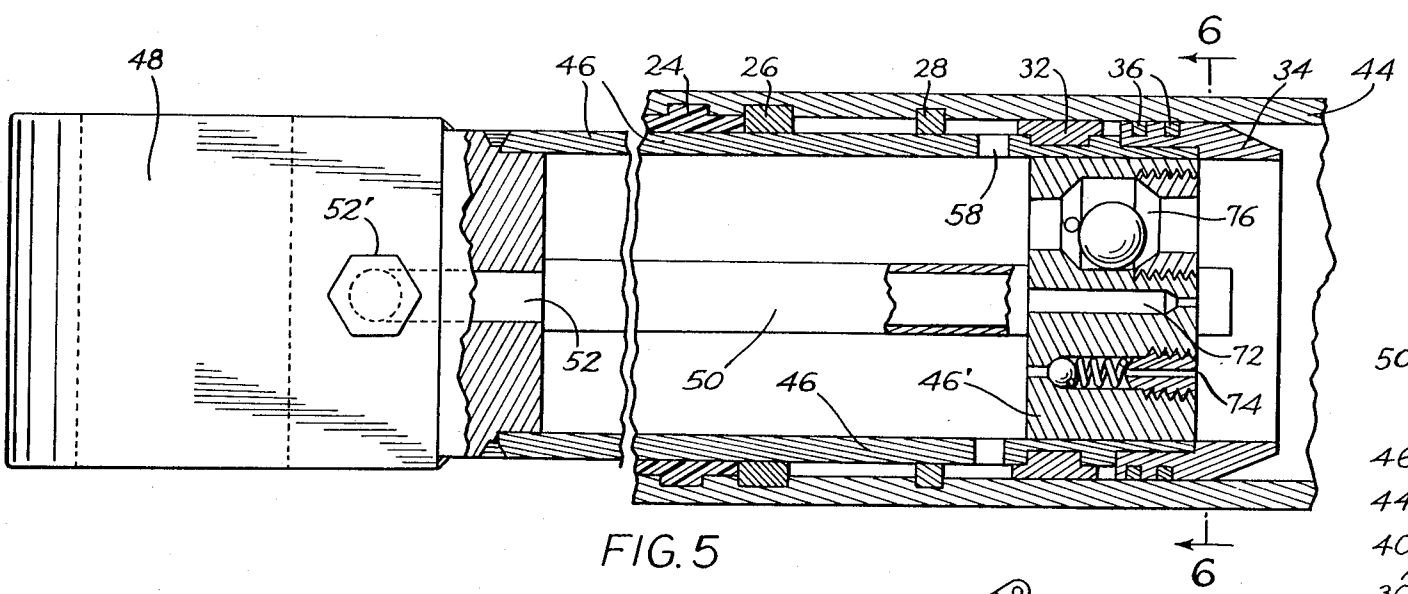
FIG. 5 is a fragmentary longitudinal section showing a modification of the innermost stage of the cylinder of FIG. 2 to provide a shock absorber function.
Figure 6:
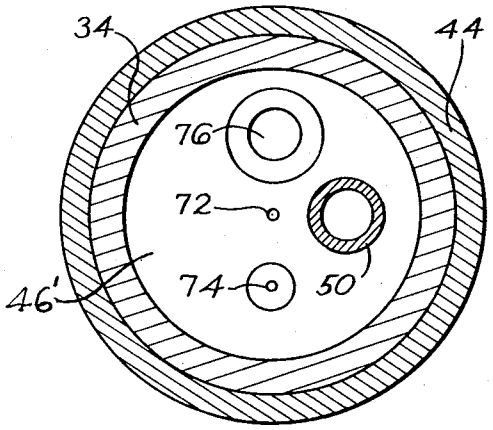
FIG. 6 is a sectional view of the shock absorber structure of the cylinder of FIG. 5, taken along the line 6—6 in FIG. 5.

Referring now to FIGS. 5 and 6, a shock absorber structure is shown associated with the piston stage 46 of the cylinder assembly of FIG. 2. The piston plug or head 46' is arranged to incorporate a metering orifice 72, an appropriate conventional relief valve 74, and a one-way ball check valve 76, as well as an opening for the extension port tube 50 to pass into the cylinder cavity 54. The function of this arrangement is to trap the oil in the annular space between the piston stage 46 and the adjacent cylinder stage and meter it out at a high pressure to give a resisting or "shock absorbing" effect on the extension of the last stage.

For the purpose of this shock absorbing function, port 52 must be eliminated or blocked. It may simply be plugged, as by screw 52'. Alternatively, it may be selectively closed by an electrically actuated valve automatically upon sensing an excessively high pressure fluid flow of oil escaping the piston cylinder cavity 56 to the reservoir during a shock.

The operation of the shock absorber cylinder is as follows: With the cylinder extending under pressure in cylinder cavity 54 in the normal manner, after the next to the last stage 44 is fully extended, the piston stage 46 starts to extend. Due to the double acting piston ring seal 36 or 32', the oil in the annular space between the stages is forced into the piston cavity 56 through the port 58 in the piston stage tubing. The oil is then forced out through the metering valve 72 into cylinder cavity 54, resulting in a pressure rise in the annular space which resists the piston stage's movement. The greater the speed, the higher the pressure and the greater the resisting force.

The pressure continues to rise to the preset limit of the relief valve 74 which protects the tube 46 from damage due to severe high pressure. When the piston is fully extended, it stops in the normal manner.

Accordingly, if a rock or other object should impact the rearward end of the bed 64 with sufficient force to accelerate extension of the piston section, the acceleration will be effectively dampened.

On the return stroke, the oil must re-enter the piston cavity 56 from cylinder cavity 54 without any restriction so as not to slow down the retract stroke. This is the purpose of the one-way ball check 76, which allows oil to flow freely in this one direction and be fully blocked in the other.

From the foregoing it will be appreciated that this invention provides a variable stage, dual acting, shock absorbing telescopic hydraulic cylinder characterized by the absence of excessive welding, threading and machining. This simplified construction is reflected in lower cost of manufacture and maintenance, ease of service and more consistent performance.

It will be understood that this telescopic cylinder construction may utilize any form of fluid pressure, such as pneumatic or the hydraulic pressure exemplified hereinbefore.

It will be apparent to those skilled in the art that various changes may be made in the size, shape, type, number and arrangement of the parts described hereinbefore. For example, the number of internal grooves in the base member and cylinder stages may be greater than five, to accommodate double sets of bearing rings 24 and double stop rings 28 separated by a spacer for very high pressure cylinders. Similarly, additional external grooves may be provided on the cylinders to accommodate double guide bearings rings 32, or 32' separated by a spacer, for very high pressure cylinders. The piston members 34 may be omitted on the single acting stages, or their piston rings 36 may be removed, or the single split rings 32' may be replaced by pairs of semi-circular rings 32. The fluid port 50 for the extension mode may be located in the base member 10 if the outer cylinder stage 30 is single acting, or in the trunnion 12, or in the blind head 14 as indicated by the plugged port 50' in FIG. 1. These and other changes and modifications may be made without departing from the spirit of this invention and the scope of the appended claims.

Having thus described my invention and the manner in which it may be used, I claim:

1. A double acting telescopic fluid pressure cylinder, comprising:

(a) a hollow cylindrical base member of substantially uniform wall thickness arranged to be mounted for support, (b) the base member having an end closure at one end defining an adjacent cylinder cavity, (c) the base member having near its open end a set of longitudinally spaced machined grooves on its interior surface removably mounting outer end performance rings, (d) at least one telescoping cylinder stage of substantially uniform wall thickness slidably received through said rings in the base member, (e) each said uniform wall thickness telescoping cylinder stage having a set of internal grooves machined in its wall surface near its outer end removably mounting outer end performance rings, each cylinder stage also having near its inner end an internal groove machined in its wall surface removably receiving a lifting ring arranged for abutment with the adjacent inner cylinder stage, (f) a hollow piston stage of substantially uniform wall thickness slidably received through the rings in the innermost cylinder stage and arranged for abutment with the lifting ring of the adjacent cylinder stage, (g) closure members adjacent the inner and outer ends of the hollow piston stage defining a piston cavity between them, (h) each stage having in its wall surface near its inner end at least one external annular piston ring receiving groove disposed outwardly of said lifting ring groove, (i) fluid sealing piston ring means mounted removably in said external piston ring receiving groove on the inner end of the piston stage and any desired cylinder stage sequentially outward from the piston stage, the piston ring means being arranged to provide a fluid seal between each piston ring stage and the next adjacent outer cylinder stage for rendering each said piston ring stage double acting, (j) first fluid pressure passageway means communicating the cylinder cavity in the base member with a source of fluid under pressure and exhaust for applying fluid pressure against the inner side of each piston ring means for extending the associated stage, (k) second fluid pressure passageway means communicating said piston cavity with a source of fluid under pressure and exhaust, and (l) third fluid pressure passageway means in each piston ring stage communicating said piston cavity with the outer side of each piston ring means for applying fluid under pressure thereto for retracting the associated stage.

2. The cylinder of claim 1 wherein the first fluid passageway extends from the outer end closure member of the piston stage through the inner end closure member thereof.

3. The cylinder of claim 1 wherein the first fluid pressure passageway extends through the end closure of the base member.

4. The cylinder of claim 1 wherein the piston ring means is on the piston stage only, providing double action thereof while providing single action of all other cylinder stages, and closure means closes any third fluid pressure passageway associated with the next adjacent, larger telescoping cylinder stage.

5. The cylinder of claim 1 wherein the fluid sealing piston ring means comprises a piston member on the inner end of the associated stage mounting a piston ring, the piston member also having said internal machined groove receiving said lifting ring inwardly of the piston ring.

6. The cylinder of claim 1 wherein the fluid sealing piston ring means comprises a fluid sealing guide bearing ring mounted in a groove in the associated uniform wall thickness stage outwardly of said lifting ring.

7. A double acting telescopic fluid pressure cylinder, comprising:

(a) a hollow cylindrical base member of substantially uniform wall thickness arranged to be mounted for support, (b) the base member having an end closure at one end defining an adjacent cylinder cavity, (c) the base member having near its open end a set of longitudinally spaced machined grooves on its interior surface removably mounting outer end performance rings, (d) at least one telescoping cylinder stage of substantially uniform wall thickness slidably received through said rings in the base member, (e) each said uniform wall thickness telescoping cylinder stage having a set of internal machined grooves therein near its outer end removably mounting outer end performance rings, each cylinder stage also having near its inner end an internal machined groove removably receiving a lifting ring arranged for abutment with the adjacent inner cylinder stage, (f) a hollow piston stage of substantially uniform wall thickness slidably received through the rings in the innermost cylinder stage and arranged for abutment with the lifting ring of the adjacent cylinder stage, (g) closure members adjacent the inner and outer ends of the hollow piston stage defining a piston cavity between them, (h) each stage having near its inner end at lest one external, annular piston ring receiving groove disposed outwardly of said lifting ring groove, (i) fluid sealing piston ring means in said external piston ring receiving groove on the inner end of at least one of the stages arranged to provide a fluid seal between said stage and the next adjacent outer stage cylinder for rendering said stage double acting, (j) first fluid pressure passageway means communicating the cylinder cavity in the base member with a source of fluid under pressure and exhaust for applying fluid pressure against the inner side of each piston ring means for extending the associated stage, (k) second fluid pressure passageway means communicating said piston cavity with a source of fluid under pressure and exhaust, (l) third fluid pressure passageway means communicating said piston cavity with the outer side of each piston ring means for applying fluid under pressure thereto for retracting the associated stage, and (m) the piston stage including a shock absorber mechanism comprising a metering orifice and a one-way ball-check valve extending through the inner closure member of the piston stage to interconnect said piston and cylinder cavities, the metering orifice arranged to meter fluid in said piston cavity out at a high pressure into said cylinder cavity to give a resisting effect on the extension of the piston stage, the ball-check valve arranged to permit the free flow of fluid from said cylinder cavity to said piston cavity during normal retraction of the piston stage, and means for closing said second fluid pressure passageway means.

8. The cylinder of claim 7 including a relief valve extending through the inner closure member of the piston stage and arranged to limit fluid pressure in the piston cavity to a predetermined maximum magnitude.

9. A telescopic fluid pressure cylinder, comprising:

(a) a hollow cylindrical base member of substantially uniform wall thickness arranged to be mounted for support, (b) the base member having an end closure at one end defining an adjacent cylinder cavity, (c) the base member have near its open end a set of longitudinally spaced machined grooves on its interior surface removably mounting outer end performance rings, (d) at least one telescoping cylinder stage of substantially uniform wall thickness slidably received through said rings in the base member, (e) each said uniform wall thickness telescoping cylinder stage having a set of internal machined grooves therein near its outer end removably mounting outer end performance rings, each cylinder stage also having near its inner end an internal machined groove removably receiving a lifting ring arranged for abutment with the adjacent inner cylinder stage, (f) a hollow piston stage of substantially uniform wall thickness slidably received through the rings in the innermost cylinder stage and arranged for abutment with the lifting ring of the adjacent cylinder stage, (g) closure members adjacent the inner and outer ends of the hollow piston stage defining a piston cavity between them, (h) fluid sealing piston ring means on the inner end of the piston stage arranged to provide a fluid seal between said piston stage and the next adjacent outer cylinder stage, (i) first fluid pressure pasageway means communicating the cylinder cavity in the base member with a source of fluid under pressure and exhaust for applying fluid pressure against the inner side of the piston ring means member for extending the piston stage, (j) second fluid pressure passageway means in the piston stage communicating said piston rings cavity with the outer side of said piston ring means, and (k) a metering orifice and a one-way ball check valve extending through the inner closure member of the piston stage to interconnect said piston and cylinder cavities, the metering orifice arranged to meter fluid in said piston cavity out at a high pressure into said cylinder cavity to give a resisting effect on the extension of the piston stage, the ball check valve arranged to permit free flow of fluid from said cylinder cavity to said piston cavity during normal retraction of the piston stage.

10. A double acting telescopic fluid pressure cylinder, comprising:

(a) a hollow cylindrical base member of substantially uniform wall thickness arranged to be mounted for support, (b) the base member having an end closure at one end defining an adjacent cylinder cavity, (c) the base member having near its open end a set of longitudinally spaced machined grooves on its interior surface removably mounting outer end performance rings, (d) at least one telescoping cylinder stage of substantially uniform wall thickness throughout its entire length slidably received through said rings in the base member, (e) each said uniform wall thickness telescoping cylinder stage having a set of internal grooves machined in its wall surface near its outer end removably mounting outer end performance rings, each cylinder stage also having near its inner end an internal groove machined in its wall surface removably receiving a lifting ring arranged for abutment with the adjacent inner cylinder stage, (f) a hollow piston stage of substantially uniform wall thickness throughout its entire length slidably received through the rings in the innermost cylinder stage and arranged for abutment with the lifting ring of the adjacent cylinder stage, (g) closure members adjacent the inner and outer ends of the hollow piston stage defining a piston cavity between them, (h) each telescoping stage having in its uniform thickness wall surface near its inner end at least one external annular ring-receiving groove disposed outwardly of said lifting ring groove, (i) fluid sealing guide bearing piston ring means mounted removably in said external annular ring-receiving groove in the piston stage and any desired cylinder stage sequentially outward from the piston stage, the ring means configured as a resilient, split guide bearing ring arranged, when disposed in said receiving groove, to engage the inner wall surface of the next adjacent larger stage of the cylinder for providing a guide bearing contact therewith and a fluid pressure seal between the two stages associated therewith for rendering said fluid sealing guide bearing piston ring-mounting stage double acting, (j) first fluid pressure passageway means communicating the cylinder cavity in the base member with a source of fluid under pressure and exhaust for applying fluid pressure against the inner side of each fluid sealing guide bearing piston ring means for extending the associated stage, (k) second fluid pressure passageway means communicating said piston cavity with a source of fluid under pressure and exhaust, and (l) third fluid pressure passageway means in each piston ring stage communicating said piston cavity with the outer side of each fluid sealing guide bearing piston ring means for applying fluid under pressure thereto for retracting the associated stage.

11. The cylinder of claim 10 wherein the inner end of said fluid sealing guide bearing ring means provides the additional function of providing a confronting edge surface against which the lifting ring associated with the next adjacent larger telescoping stage may abut during extension of the cylinder, for moving the smaller stage outwardly with the outward extension movement of said adjacent larger stage.

* * * * *